US006981607B2

(12) United States Patent
Lown et al.

(10) Patent No.: US 6,981,607 B2
(45) Date of Patent: Jan. 3, 2006

(54) CONTAINER CAP ASSEMBLY

(75) Inventors: John M. Lown, Huntington Beach, CA (US); Todd S. Ray, Spokane, WA (US)

(73) Assignee: Snapware Corporation, Mira Loma, CA (US)

( * ) Notice: Subject to any disclaimer, the term of this patent is extended or adjusted under 35 U.S.C. 154(b) by 0 days.

(21) Appl. No.: 10/652,744

(22) Filed: Aug. 29, 2003

(65) Prior Publication Data

US 2005/0045577 A1 Mar. 3, 2005

(51) Int. Cl.
*B65D 51/04* (2006.01)

(52) U.S. Cl. ..... 220/254.3; 220/375; 220/780; 220/834; 220/836; 220/845; 220/760; 215/235; 215/306; 222/556

(58) Field of Classification Search ..... 220/254.3, 220/837, 845, 752, 375, 780, 834, 836, 760; 215/237, 235, 306, 317; 222/556
See application file for complete search history.

(56) References Cited

U.S. PATENT DOCUMENTS 2,690,861 A * 10/1954 Tupper ..... 222/498
2,852,054 A * 9/1958 Motley ..... 220/834
2,882,947 A * 4/1959 Close ..... 220/254.3
2,889,087 A * 6/1959 Paull et al. ..... 222/498
2,958,439 A * 11/1960 Yochem ..... 220/834
3,133,311 A * 5/1964 Riebsamen ..... 16/110.1
3,214,881 A * 11/1965 Hayes ..... 53/485
3,272,368 A 9/1966 Baarn
3,302,826 A * 2/1967 Henchert et al. ..... 220/752
3,651,992 A 3/1972 Hazard
3,695,476 A 10/1972 Ruekberg
4,380,304 A * 4/1983 Anderson ..... 220/782
4,386,714 A * 6/1983 Roberto et al. ..... 220/834
4,414,705 A * 11/1983 Ostrowsky ..... 16/225
4,494,679 A * 1/1985 Cleevely ..... 222/151
4,667,839 A 5/1987 Crisci
4,718,567 A 1/1988 La Vange
4,765,506 A 8/1988 Fishman et al.
4,782,964 A 11/1988 Poore et al.
4,809,874 A 3/1989 Pehr
5,031,784 A 7/1991 Wright
5,048,715 A * 9/1991 Wolff ..... 220/832
5,078,291 A * 1/1992 Gilmour ..... 215/284
5,078,304 A * 1/1992 Schneider ..... 222/168
5,083,671 A 1/1992 Hayes
5,133,470 A * 7/1992 Abrams et al. ..... 215/250
5,145,646 A * 9/1992 Tyranski ..... 422/102
5,197,624 A 3/1993 Dodaro
5,305,900 A 4/1994 Maguire et al.

(Continued)

FOREIGN PATENT DOCUMENTS

FR 865.056 5/1941
FR 2494-227 5/1982

*Primary Examiner*—Nathan J. Newhouse
*Assistant Examiner*—James N. Smalley
(74) *Attorney, Agent, or Firm*—Harold L. Jackson

(57) ABSTRACT

A container cap assembly comprises a one-piece integrally molded annular cap body hinged to a one-piece integrally molded lid. The cap body has a lower section with internal female threads for cooperation with matching male threads on a container and an annular upwardly extending flange. The lid has a downwardly extending flange. The flanges have interlocking sealing surfaces which extend outwardly at an acute angle to the vertical so that the lid flange will snap over the cap body flange in the closing mode and retain the lid in a closed and sealed position relative to the cap body until the lid is forced upwardly.

18 Claims, 6 Drawing Sheets

U.S. PATENT DOCUMENTS 5,312,011 A * 5/1994 Fischer ..... 220/528
5,320,232 A * 6/1994 Maguire et al. ..... 215/245
5,335,802 A 8/1994 Brach et al.
5,346,099 A * 9/1994 Salmon et al. ..... 222/153.06
5,392,938 A 2/1995 Dubach
5,398,837 A * 3/1995 Degrassi ..... 220/835
5,462,185 A * 10/1995 Walker, III ..... 215/307
5,464,112 A * 11/1995 Guillot ..... 215/254
5,547,109 A * 8/1996 Robbins, III ..... 222/158
5,582,314 A 12/1996 Quinn et al.
5,863,655 A * 1/1999 Mock ..... 428/411.1
5,927,535 A * 7/1999 Goth ..... 220/254.3
5,975,346 A * 11/1999 Imperato et al. ..... 220/831
6,050,434 A * 4/2000 McNab ..... 215/235
D444,027 S * 6/2001 Gilliam et al. ..... D7/392.1
6,299,005 B1 10/2001 Higgins
6,382,476 B1 * 5/2002 Randall et al. ..... 222/545
6,460,712 B2 * 10/2002 Smith et al. ..... 215/235
6,488,187 B2 * 12/2002 Sheffler et al. ..... 222/480
6,631,820 B2 * 10/2003 Harrold et al. ..... 215/237
6,761,279 B1 * 7/2004 Martin et al. ..... 220/258.2
6,761,283 B1 * 7/2004 Gilliam et al. ..... 220/837
6,772,904 B1 * 8/2004 Gilliam et al. ..... 220/836
2002/0088813 A1 7/2002 Nyman et al.
2002/0104843 A1 8/2002 Smith et al.
2004/0089627 A1 * 5/2004 Smith et al. ..... 215/237

* cited by examiner

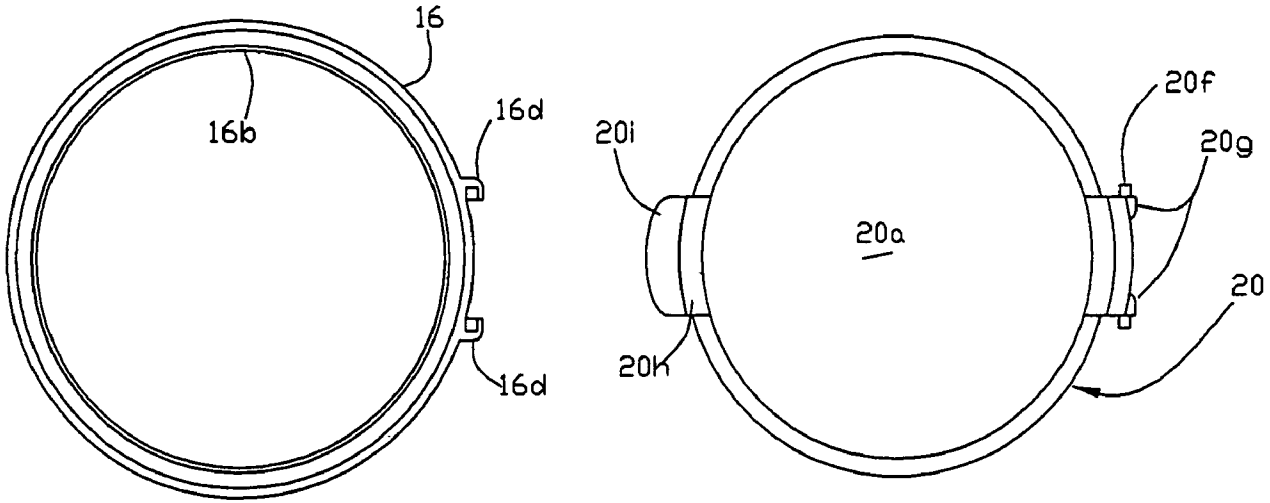
Figure 2
Figure 3
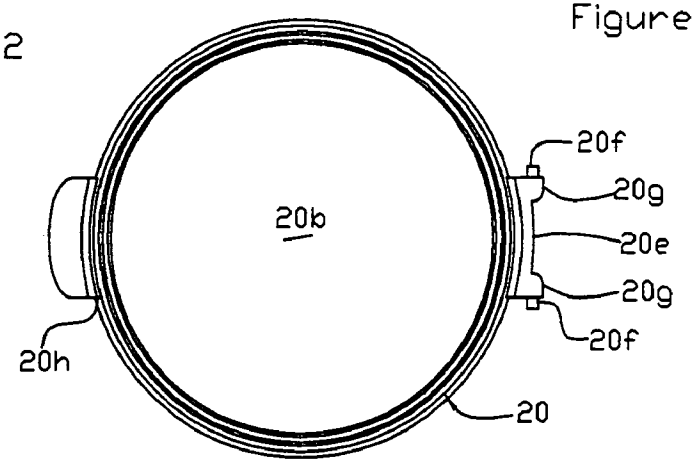
Figure 4

CONTAINER CAP ASSEMBLY

FIELD OF THE INVENTION

The present invention relates to a hinged cap assembly for capping containers and particularly to large mouth containers where a liquid tight seal is desired.

DESCRIPTION OF THE PRIOR ART

There are many known varieties and shapes of container caps including bottle-type caps that have been and are presently in use. The known caps differ in configuration and arrangement int hat some are formed as just single cap members having cooperative sizes to conform to the sizes of the containers or bottles. Some are defined as simple snap-on caps and others are provided with internal threads arranged to match the threaded arrangements of particular designed containers.

Conventional snap-lid type of caps inherently do not provide a positive seal to establish a long shelf life for liquids or edibles stored therein. The caps are commonly formed from plastic materials and are snapped onto the container mouth. Such bottle caps as these are generally not provided with any type of sealing means such as gaskets.

Threaded lids generally include gaskets, but are not handy to use, especially for large mouth containers.

Containers and lids for storing foodstuffs and the like are generally made of a plastic material such as polypropylene or polyethylene polymers or copolymers. Such containers and lids are normally fairly rigid, but may be subject to some amount of flexure especially where the lid or cover is arranged to be peeled off of the container mouth. Most such container/lid configurations provide a sealing bead or rim along the upper wall of the container with a mating channel on the lid which engages the bead as well as the adjacent inner and outer surfaces of the container wall. Such sealing arrangements generally require considerable effort to force the lid onto the sealing bead during the closing procedure and perhaps greater effort to peal the lid away from the container during the opening process. While some lids are provided with one or more outwardly extending tabs to accommodate a user's fingers, the opening procedure may be quite difficult for a person suffering from arthritis or tendinitis. In addition, the lids of such sealable containers often become misplaced making lid replacement difficult or impossible. See U.S. Pat. No. 4,765,506.

In some designs a separate sealing member such as an o-ring or annular gasket is disposed between the container rim and the lid channel to provide a more secure seal. Such designs may rely on frictional forces to maintain the lid in place on the container or may rely on one or more latching arms carried by the lid which engage retention lips on the container or nut threaded onto the container. In either case the separate sealing member, i.e., o-ring or gasket involves not only added manufacturing costs, but is subject to being misplaced or lost during use of the container. See U.S. Pat. No. 5,582,314, issued to the assignee of this application.

There is a need for a two-piece hingeable cap assembly for large mouth containers which is simple, relatively inexpensive to manufacture, substantially leak proof and easy to open and close.

SUMMARY OF THE INVENTION

The present invention comprises a container cover or lid member hingeably mounted to a cap body that is internally threaded so as to be readily secured to any compatible threaded neck portion of a container. The cap body has a lower section with an inner threaded wall, an outer wall and an upwardly extending flange defining n annular exterior sealing surface which tapers outwardly at an angle θ with respect to the vertical and terminates in a free edge.

The lid member has a top surface and a bottom surface, a peripheral rim and a downwardly extending inner flange defining an interior sealing surface which tapers inwardly at an angle λ with respect to the vertical. The lid flange is arranged to snap over the cap body flange to secure the lid member in a closed position when the lid member is pressed downwardly with the sealing surfaces forming an interference fit along a narrow ring circumscribing the contact between the sealing surfaces to provide a liquid tight seal between the lid and cap body. The angle θ should be greater than λ with the difference between the angles being preferably with the range of about 2° to 8° depending upon the diameter of the container mouth.

It is an object of the present invention to provide an inexpensive, reliable and substantially leak proof two piece hingeable container cap assembly which does not rely on a separate gasket or o-ring to provide the seal or a separate latch arrangement to lock the lid to the cap body in the closed position.

It is a further object of this invention to provide a hingeable lid/cap body for large mouth containers which is easily opened by those suffering from arthritis or tendinitis problems.

The construction and operation of the container cap assembly of the present invention may be best understood by reference to the following description taken in conjunction with the accompanying drawings.

BRIEF DESCRIPTION OF THE DRAWINGS

FIGS. 2 and 3 are top plan views of the disassembled cap body an lid member, respectively;

FIG. 4 is a bottom view of the lid member.

DESCRIPTION OF THE PREFERRED EMBODIMENT

Figure 1:
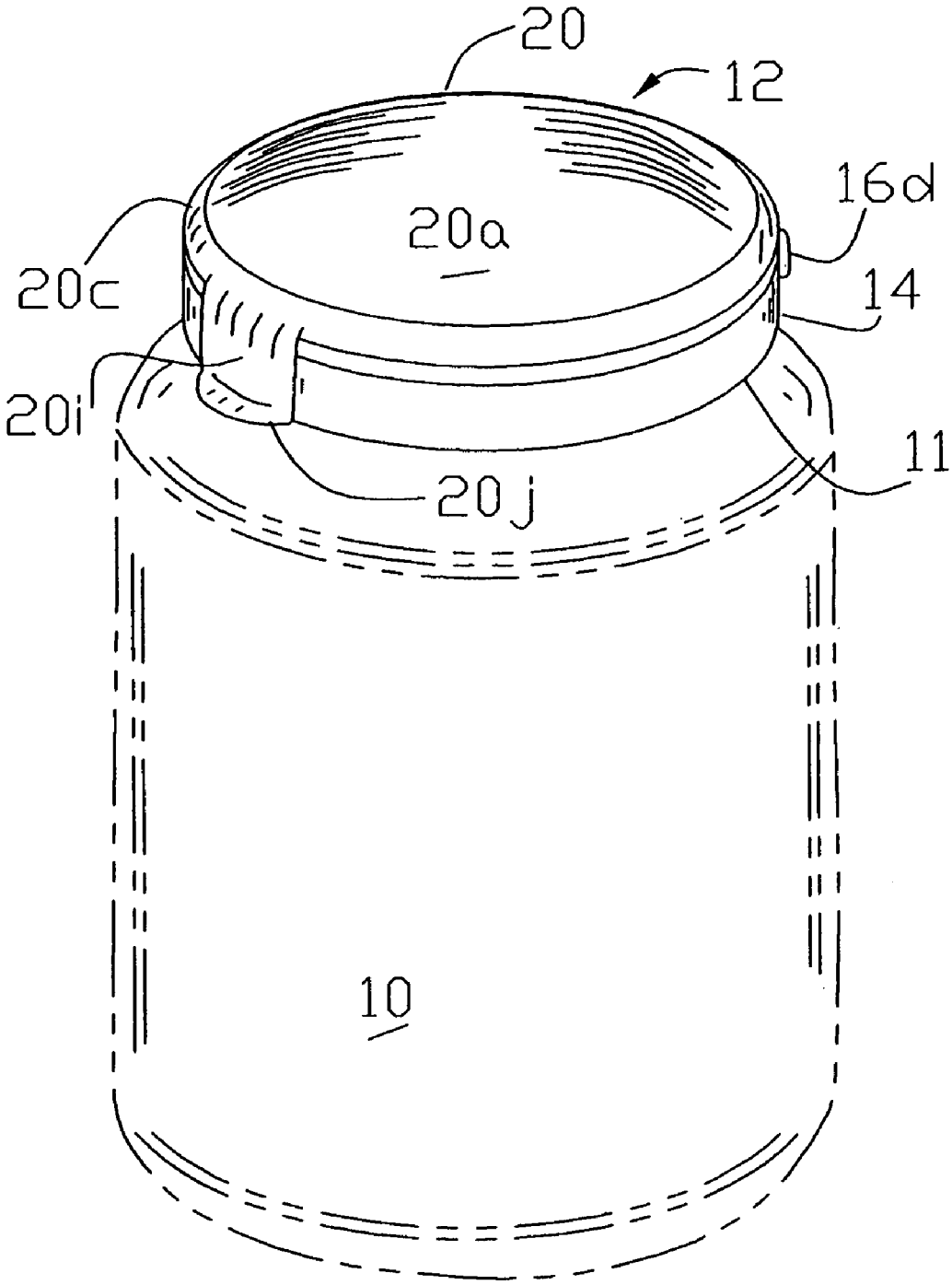
FIG. 1 is a perspective view of the container cap assembly as mounted on a large mouth container.
Figure 6:
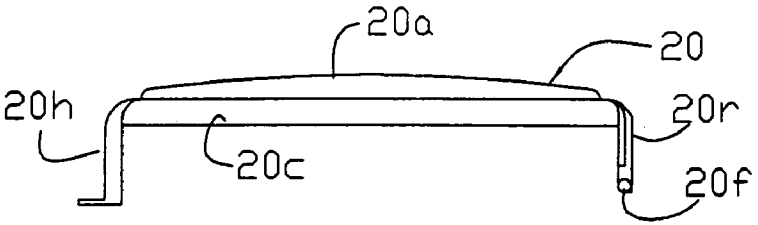
FIGS. 5 and 6 are side elevational views of the cap body and lid member, respectively.
Figure 5:
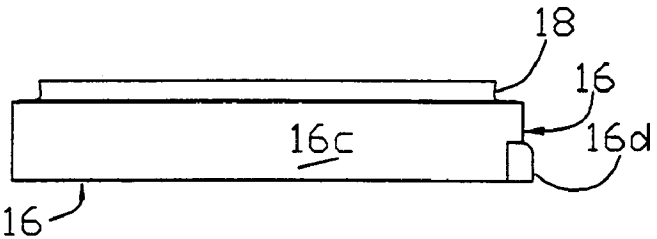
Figure 7:
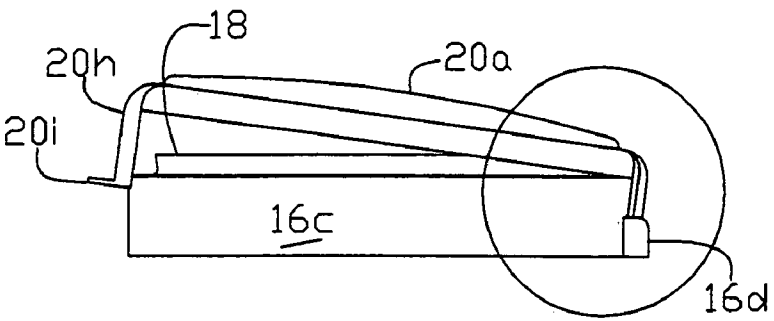
FIG. 7 is a side elevational view of the assembled cap body and lid member showing the lid being rotated toward a closed position.

Referring more particularly to FIG. 1, there is shown a pictorial view of a container 10 having a neck portion 11 on which is commonly formed an external thread (not shown). It should be readily understood that container 10 is illustrative of various types and sizes of containers, such as bottles, jars, and the like, that hold liquids as well as dry food products.

A container cap assembly, generally designated at 12, is shown mounted on the container 10 and is formed from a suitable rigid or semirigid thermoplastic material of, for example, the polyolifin group, such as high density polyethylene, more preferably from a polypropylene that provides some flexibility and memory. Polypropylene is believed to be the least expensive of most commonly used plastics for molding many consumer products and thus advantageous from the cost standpoint. The container 10 is illustrated as a large mouth container, for example, having a standard diameter of 53 mm, 63 mm, 89 mm, 110 mm or 120 mm.

Figure 14:
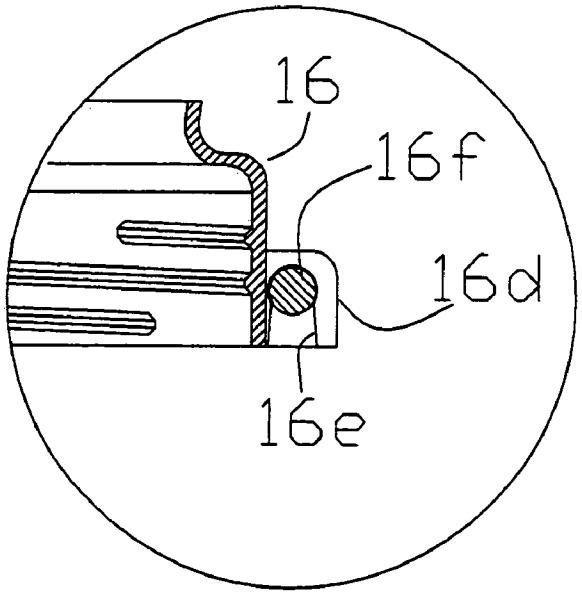
FIG. 14 is an enlarged cross-sectional view of the portion of the cap body circled in FIG. 5 showing the lid Axle receiving slot with a lid axle disposed therein.

Referring now to the remaining figures, the container cap assembly 12 comprises a one piece annular cap body or nut 14 formed with a lower and upper section 16, 18, respectively, and a one piece lid member 20. The lower cap body section is formed with threads 16*b* on the interior surface 16*a* thereof See FIG. 12. The outer surface 16*c* of the lower section surrounds the neck of the container, as is illustrated in FIG. 1. The lower section or wall 16 is formed with a hinge housing in the form of two spaced hubs 16*d* which define upwardly extending slots 16*e* terminating in semicylindrical bores 16*f* for receiving a pair of stub axles formed on a lid member to be described. See FIG. 14.

Figure 12:
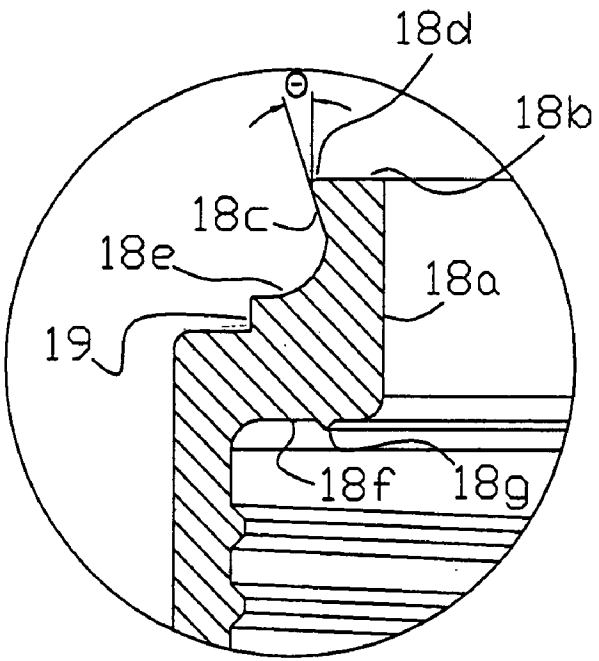
FIG. 12 is an enlarged cross-sectional view of the cap body flange of FIG. 11 illustrating the angular orientation of the sealing surface thereon.

The upper section 18 of the cap body is in the form of an upwardly extending flange joined to the lower section via a rib section 19 (FIG. 12). The flange 18 has an interior surface 18*a* providing substantially unobstructed access to the interior of the container when the lid is in the open position. The flange 18 terminates at its upper end in a substantially flat peripheral rim 18*b*.

The flange 18 defines an inner sealing surface 18*c* which extends downwardly from the exterior corner 18*d* of the rim at an angle of θ degrees with respect to the vertical. A rounded corner 18*e* is formed between the lower end of the sealing surface and the web section as is shown more particularly in FIG. 12. The bottom surface 18*f* of the flange forms a downwardly projecting lip 18*g* for sealingly engaging the top rim of the container 10. The rim corner 18*d* preferably is relieved by a small radius e.g, about 0.040".

Figure 8:
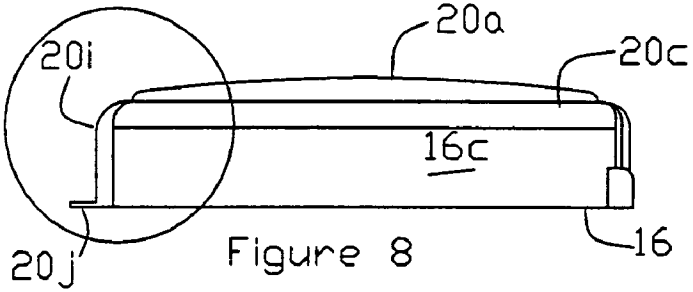
FIG. 8 is a side elevational view of the cap body and lid member with the lid in a closed position.
Figure 13:
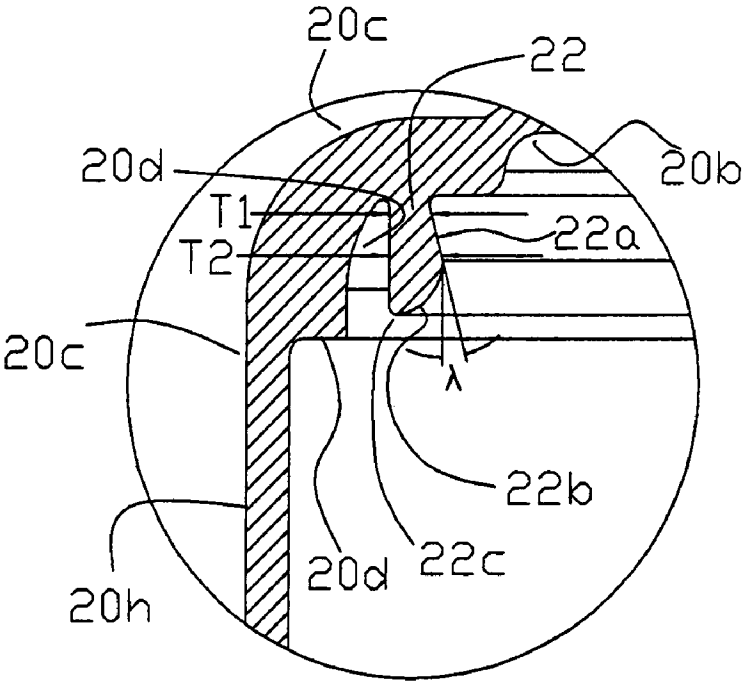
FIG. 13 is an enlarged cross-sectional view of the lid flange of FIG. 11 illustrating the angular orientation of the sealing surface thereon.
Figure 15:
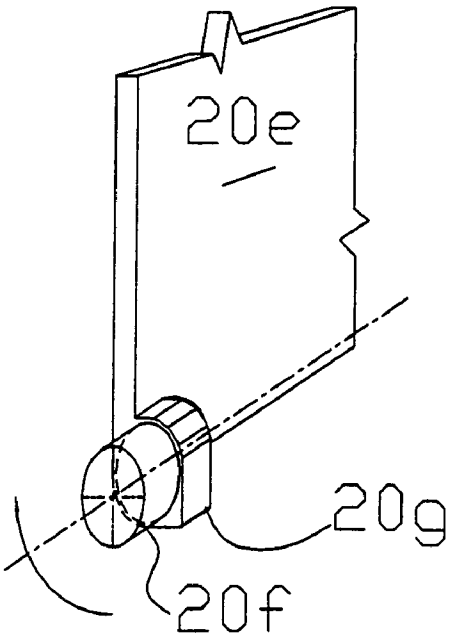
FIG. 15 is a broken away perspective view of one of the lid axles and adjacent support.

The lid member 20 has a slightly convex shaped top surface 20*a*, a bottom surface 20*b* of matching curvature and a peripheral rim 20*c*, (FIGS. 3, 4, and 8). A flange 22, extending downwardly from the rim 20*c*, is arranged to engage the exterior surface of the cap body flange and provide a substantially leak proof seal between the lid and cap body and also to releasably lock the assembly together, as will be more fully explained in connection with FIGS. 11–13. The flange 22 is provided with an interior sealing surface 22*a* which is joined to a lower rounded surface 22*b*, terminating at a free end 22*c*. The exterior surface 22*d* of the flange 22 is spaced from the interior surface 20*d* of the depending portion of the peripheral rim 20*c* as is illustrated in FIG. 13.

The sealing surface 22*a* of the lid flange is oriented at an angle of λ to the vertical in the unstressed condition of the flange, i.e., when the lid is in the open position and positioned horizontally. See FIG. 13.

A downwardly extending hinge plate 20*e* is formed integrally with the lid peripheral rim and carries at it's lower end a pair of outwardly projecting axle stubs 20*f* During assembly of the lid and cap body, the axle stubs are forced into the semicylindrical bores 16*f* at the end of the slots 16*e* in the cap body. See FIG. 14. The slots are formed with a width slightly less than the diameter of the axle stubs to retain the lid on the cap body. The hinge plate includes protrusions 20*g* adjacent the fixed end of the axle stubs which engage the exterior surface of the cap body lower section when the lid is rotated to an angle of about 90° from its closed position. The protrusions tend to force the axles outwardly as the lid is rotated past the 90° angle until the lid is positioned about parallel to the plane of the cap body, i.e., when the lid has rotated through about 180°. The lid is held in this open position until a small force is applied to the lid to rotate it toward its closed position.

A downwardly extending tongue 20*h* is positioned diametrically opposite the hinge and is formed integrally with the lid peripheral rim. The tongue 20*h* includes, at its lower end, an outwardly extending finger engaging member 20*i*.

During the closing mode, the lid member is pushed downwardly against the cap body and container causing the rounded end 22*b* of the sealing flange to engage the corner 18*d* of the cap body flange and flex outwardly a slight amount allowing the lid flange to continue to move downwardly along the tapered sealing surface of the cap body flange. The resilience of the material causes the lid flange to flex against the tapered cap body sealing surface and releasably lock the lid to the cap body in the position shown in FIG. 11. This action eliminates the need for a separate latching mechanism as required, for example, in the '314 patent. At the same time the sealing surfaces of the two flanges form substantially a line or narrow annular band contact 24 on or adjacent the rounded corner 24 at the upper end of the cap body flange. See FIG. 11. It is to be noted that a rib having s small radius adjacent the top of the cap body sealing surface, instead of the rounded corner, would also serve to provide an effective line seal.

The force exerted between the flange sealing surfaces along this line contact forms a substantially liquid tight seal preventing the contents in the container from spilling. It is to be noted that in the event that a filled container is turned upside down the pressure on the lower surface of the lid will increase the pressure between the sealing surfaces to prevent leakage.

We have found that a minimum pressure of about 1.5 pounds square inch between the sealing surfaces, with container in an upright position, will provide the required seal while allowing the seal to be broken and the lid opened with reasonable effort. The container cap assembly of this invention is user friendly even to those individuals who have limited strength in the hands as a result of arthritis or tendinitis.

The angles θ and λ are important in achieving the above results. The angles θ and λ are preferably different with θ being larger than λ by about 2° or more depending upon the size of the containers for which the container cap assembly is designed and λ can vary within the ranges of about 14° to 24° and 10° to 18°, respectively. Preferably θ and λ are within the ranges of about 16° to 20° and 12° to 16°, respectively. Most preferably θ is about 18° and λ is about 14°.

Figure 11:
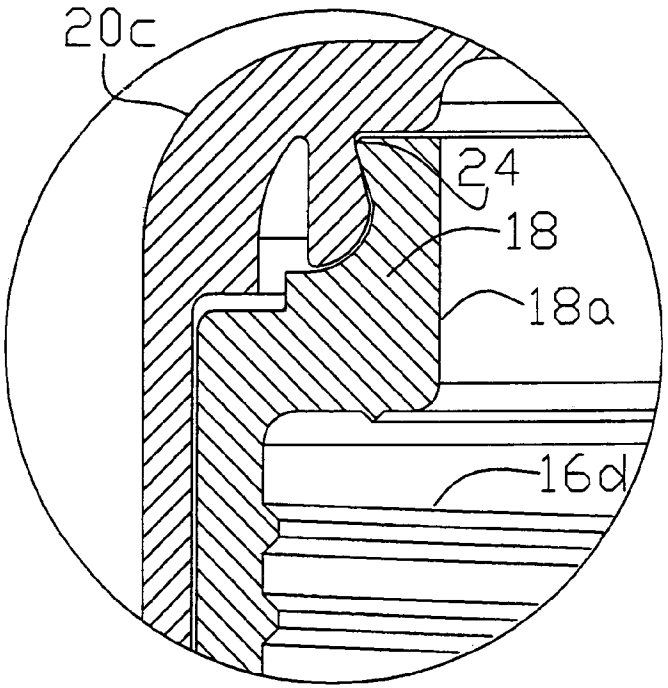
FIG. 11 is an enlarged cross-sectional view of the front of the assembled lid and cap outlined in the circle of FIG. 8 showing the sealing surface of the lid and cap flanges providing an interference fit along a ring circumscribing a portion fo such surface.

The cap body and lid are preferably injection molded from polypropylene having a Rockwell R hardness of between about 60 and 100 and most preferably about 80. We have found that a nominal wall thickness of 0.070" for the cap body and lid member provides adequate strength for the assembly. We have also found that a wall thickness $t_1$ of about 0.045" for the neck at the upper end of the lid flange is adequate to provide the necessary flexibility to allow the flange 22 to flex outwardly over the rounded edge 18*d* of the cap lid flange and snap into its locked position as shown in FIG. 11 when the lid is pressed downwardly in a closing mode. The thickness $t_2$ of the lid flange 22 at the intersection of the sealing surface 22*a* and the rounded terminal end 22*b* is preferably about 0.060" to be compatible with the foregoing dimensions. The periphery of this intersection is obviously greater than the periphery of the adjacent section of the flange 18*h* (in the closed position) to releasably secure the lid to the cap body in the closed position. See FIG. 11.

Figure 9:
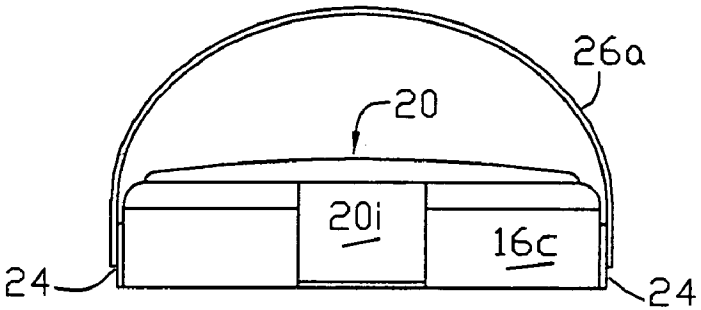
FIGS. 9 and 10 are side and front elevational views of an alternative embodiment of the invention in which the cap body is provided with a rotatable handle.
Figure 10:
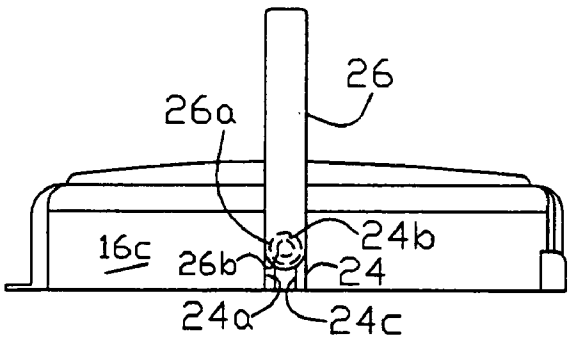

FIGS. 9 and 10 illustrate a container cap assembly in which the cap body is provided with integrally molded handle receiving housings 24 located on opposite sides of the outer wall 16*c*. The housings form an inner slot 24*a*, terminating in a semicircular recess 24*b* and outer slot 24*c*, a handle 26, also preferably made of polypropylene, includes a circular disk 26*a* mounted to each end of the handle via a reduced diameter axle 26*b*. Each end of the handle can be snapped into a respective inner slot to allow a user to conveniently carry the container.

It may be thus seen that the objects of the present invention set forth herein, as those made apparent from the foregoing description are efficiently attained. While preferred embodiments of the invention have been set forth for purpose of disclosure, modifications of the disclosed embodiments of the invention as well as other embodiments thereof may occur to those skilled in the art. Accordingly, the appended claims are intended to cover all embodiments which do not depart from the spirit and scope of the invention.

What is claimed is:

1. A container cap assembly for providing a closure for large mouth containers having male threads surrounding an open end thereof comprising:

a molded plastic annular cap body formed symmetrically about a longitudinal axis with a lower and upper section, the lower section having an outer surface and an inner surface defining female threads thereon for cooperation with matching threads on the container, the upper section of the cap body forming an annular upwardly extending flange terminating in a peripheral rim with an inner surface extending downwardly from the rim providing unobstructed access to the container interior;

a molded plastic lid member having a top surface terminating in a downwardly extending peripheral rim, a bottom surface and an annular downwardly extending flange spaced inwardly from the peripheral rim;

a hinge pivotally connecting the lid member and the cap body whereby the lid member is arranged to pivot between a closed position in which the opening in the container is closed and an open position in which unobstructed access is provided through the opening in the container, the flanges having interlocking sealing surfaces in the closed position with the sealing surfaces of the, cap body and lid member flanges extending outwardly at an acute angle $\theta$ to the vertical and inwardly at an acute angle $\lambda$ to the vertical, respectively, with $\theta \neq \lambda$ the interlocking flanges in their closed position locking the assembly together and providing the only sealing means for the container.

2. The container cap assembly of claim 1 wherein $\theta$ and $\lambda$ are within the ranges of about 8° to 24° and 10° to 18°, respectively.

3. The container cap assembly of claim 1 wherein the cap body and lid are each integrally molded as a single unit.

4. The container cap assembly of claim 1 wherein $\theta$ and $\lambda$ are within the ranges of about 15° to 21° and 12° to 16°, respectively.

5. The container cap assembly of claim 2 wherein the cap body and lid member are injection molded from a plastic having a Rockwell R hardness within the range of about 60 to 80.

6. The container cap assembly of claim 5 wherein the plastic has Rockwell R hardness of about 80.

7. The container cap assembly of claim 1 wherein the difference between $\theta$ and $\lambda$ is greater than 2°.

8. The container cap assembly of claim 7 wherein $\theta$ is about 18° and $\lambda$ is about 14°.

9. The container cap assembly of claim 2 wherein the cap body and lid member are made of polypropylene.

10. The container cap assembly of claim 1 further including a releasable handle connected to the cap body.

11. A container cap assembly for providing a closure for large mouth containers having male threads of a diameter of at least 53 mm surrounding an open end thereof comprising:

a plastic annular cap body formed having a lower and an upper section, the lower section having an outer wall and an inner wall defining female threads for cooperation with matching threads on the container, the upper section forming an upwardly extending flange terminating in a peripheral rim with an inner surface extending downwardly from the rim providing an unobstructed access to the container interior, the upwardly extending flange defining an exterior sealing surface which tapers outwardly at an acute angle of $\theta$ with respect to the vertical in the unstressed condition of the flange; and a plastic lid member pivotally hinged to the cap body whereby the lid member is arranged to pivot to a closed position in which the opening in the container is closed and an open position in which unobstructed access is provided through the opening in the container, the lid member having a top and a bottom surface and a downwardly extending flange, the lid flange defining an interior sealing surface which tapers inwardly at an angle of $\lambda$ with respect to the vertical in the unstressed condition of the lid flange, where $\theta \neq \lambda$, the lid flange being arranged to snap over the cap body flange to secure the lid member when the lid member is pressed downwardly with the sealing surfaces forming an interference fit to provide a liquid tight seal between the cap body and lid member, the flanges in their closed position providing the only closure and locking means for the container.

12. The container cap assembly of claim 11 wherein each of the flanges terminate in a free edge, the inner surface of the lid flange curving outwardly below the sealing surface thereof to engage the free edge of the cap body flange and flex said lid flange outwardly as the lid flange is snapped over the cap body flange.

13. The container cap assembly of claim 12 wherein $\theta$ is within the range of about 8° to 24° and $\lambda$ is within the range of about 10° to 18°.

14. The container cap assembly of claim 13 wherein $\theta$ is within the range of about 15° to 21° and $\lambda$ is within the range of about 12° to 16°.

15. The container cap assembly of claim 14 wherein θ is about 18° and λ is about 14°.

16. The container cap assembly of claim 12 wherein the lid member is formed with a peripheral rim extending downwardly from the top surface and outwardly from the lid flange and further including a downwardly extending tongue formed integrally with the peripheral rim, the tongue terminating in an outwardly extending finger engaging portion to aid a user in opening the lid member.

17. The container cap assembly of claim 16 wherein the hinge is formed by a pair of space axle stubs formed integrally with the lid member and opposite the tongue and a pair of upwardly extending cooperating spaced slots in the cap body member, the spaced slots terminating in semi-cylindrical bores for receiving the axle studs.

18. The container cap assembly of claim 17 wherein the slots have a slightly smaller width than the diameter of the axle studs to allow the axle studs to be snapped into the cooperating bores and wherein the axle studs are formed with an extension on one side thereof to provide a resistance to the rotation of the lid member through a preselected angle so that once the lid is rotated through said angle the lid will be held in an open position allowing unobstructed access to the opening in the container.

* * * * *